US011626695B2

(12) United States Patent
Westman et al.

(10) Patent No.: US 11,626,695 B2
(45) Date of Patent: Apr. 11, 2023

(54) ELECTRICAL CONNECTOR HAVING GROUND STRUCTURE

(71) Applicant: TE Connectivity Services GmbH, Schaffhausen (CH)

(72) Inventors: John Eugene Westman, Harrisburg, PA (US); Michael Eugene Shirk, Grantville, PA (US); Ashika Pandankeril Shaji, Camp Hill, PA (US)

(73) Assignee: TE CONNECTIVITY SOLUTIONS GmbH, Schaffhausen (CH)

( * ) Notice: Subject to any disclaimer, the term of this patent is extended or adjusted under 35 U.S.C. 154(b) by 82 days.

(21) Appl. No.: 17/384,232

(22) Filed: Jul. 23, 2021

(65) Prior Publication Data

US 2023/0028835 A1 Jan. 26, 2023

(51) Int. Cl.
*H01R 13/6585* (2011.01)
*H01R 13/6471* (2011.01)
*H01R 12/72* (2011.01)

(52) U.S. Cl.
CPC ..... *H01R 13/6585* (2013.01); *H01R 12/721* (2013.01); *H01R 13/6471* (2013.01)

(58) Field of Classification Search
CPC ..... H01R 13/6585; H01R 13/6471; H01R 12/721
USPC ..... 439/607.07
See application file for complete search history.

(56) References Cited

U.S. PATENT DOCUMENTS

| | | | | |
|---|---|---|---|---|
| 7,819,697 | B2 * | 10/2010 | Glover | H01R 13/6587 439/607.07 |
| 9,356,401 | B1 | 5/2016 | Horning et al. | |
| 9,425,556 | B1 * | 8/2016 | Pickel | H01R 13/6587 |
| 9,608,383 | B2 * | 3/2017 | Stokoe | H01R 43/18 |
| 10,361,520 | B2 * | 7/2019 | Stokoe | H01R 13/6586 |
| 10,756,492 | B2 | 8/2020 | Trout et al. | |
| 2016/0308309 | A1 * | 10/2016 | Stokoe | H01R 13/6587 |
| 2017/0179652 | A1 * | 6/2017 | Stokoe | H01R 13/6587 |
| 2018/0248289 | A1 * | 8/2018 | Cohen | H01R 13/04 |

FOREIGN PATENT DOCUMENTS

| | | | | |
|---|---|---|---|---|
| CN | 100405666 C | * | 7/2008 | H01R 13/6587 |
| DE | 602006000218 T2 | * | 9/2008 | H01R 12/724 |
| EP | 1689042 A1 | * | 8/2006 | H01R 12/724 |
| EP | 2194610 A1 | * | 6/2010 | H01R 13/514 |
| WO | WO-9811633 A1 | * | 3/1998 | H01R 13/6587 |

* cited by examiner

*Primary Examiner* — Peter G Leigh

(57) ABSTRACT

A contact assembly includes signal contact modules and ground contact modules arranged in a contact module stack. Each ground contact module includes a ground leadframe having a ground plate and a dielectric body holding the ground plate. The ground plate includes skewer pockets and spring fingers extending into the corresponding skewer pocket. The contact assembly includes ground skewers extending across the contact module stack. The ground skewers are received in corresponding skewer pockets. The spring fingers engage the ground skewers to electrically connect the ground plate to the ground skewers. Each ground plate is coupled to each of the ground skewers. The ground skewers electrically common each of the ground plates together.

20 Claims, 10 Drawing Sheets

ELECTRICAL CONNECTOR HAVING GROUND STRUCTURE

BACKGROUND OF THE INVENTION

The subject matter herein relates generally to electrical connectors.

Some electrical systems utilize electrical connectors to interconnect electrical components. For example, some systems use a receptacle connector mounted to a circuit board to interconnect with a pluggable module. The receptacle connector includes a socket or receptacle that receives a portion of the pluggable module, such as a circuit card of the pluggable module. Electrical shielding for the signal transmission lines through the electrical connectors is important. However, at high speeds, the electrical shielding of known electrical connectors may be insufficient.

A need remains for an electrical connector having a robust ground structure to provide electrical shielding for the signal conductors of the electrical connector.

BRIEF DESCRIPTION OF THE INVENTION

In one embodiment, a contact assembly is provided and includes a plurality of signal contact modules and a plurality of ground contact modules arranged in a contact module stack. The ground contact modules provide electrical shielding for corresponding signal contact modules. Each signal contact module includes a signal leadframe having signal conductors and a dielectric body holding the signal conductors. Each signal conductor includes a transition portion extending between a mating end and a terminating end. The mating end extends from the dielectric body for electrical connection with a mating signal conductor. The terminating end of the signal conductor extends from the dielectric body for termination to a circuit board. Each ground contact module includes a ground leadframe having a ground plate and a dielectric body holding the ground plate. The ground leadframe extends between a mating end and a terminating end. The mating end of the ground leadframe extends from the dielectric body. The terminating end of the ground leadframe extends from the dielectric body for termination to the circuit board. The ground plate includes skewer pockets and spring fingers extends into the corresponding skewer pocket. The contact assembly includes ground skewers extending across the contact module stack. The ground skewers are received in corresponding skewer pockets. The spring fingers engage the ground skewers to electrically connect the ground plate to the ground skewers. Each ground plate is coupled to each of the ground skewers. The ground skewers electrically common each of the ground plates together.

In another embodiment, an electrical connector is provided and includes a housing having a cavity. The housing has a card slot at a mating end of the housing. The card slot is configured to receive a card edge of a circuit card. The housing has a bottom configured to be mounted to a circuit board. The electrical connector includes a contact assembly received in the cavity. The contact assembly includes a contact module stack including a plurality of signal contact module and a plurality of ground contact modules. The ground contact modules provide electrical shielding for corresponding signal contact modules. Each signal contact module includes a signal leadframe having signal conductors and a dielectric body holding the signal conductors. Each signal conductor includes a transition portion extending between a mating end and a terminating end. The mating end of the signal conductor is positioned in the housing at the card slot to interface with the circuit card. The terminating end of the signal conductor extends from the housing at the bottom for termination to the circuit board. Each ground contact module includes a ground leadframe having a ground plate and a dielectric body holding the ground plate. The ground leadframe extends between a mating end and a terminating end. The mating end of the leadframe positioned in the housing at the card slot to interface with the circuit card. The terminating end of the ground leadframe extends from the housing at the bottom for termination to the circuit board. The ground plate includes skewer pockets and spring fingers extends into the corresponding skewer pocket. The electrical connector includes ground skewers extending across the contact module stack. The ground skewers are received in corresponding skewer pockets. The spring fingers engage the ground skewers to electrically connect the ground plate to the ground skewers. Each ground plate is coupled to each of the ground skewers. The ground skewers electrically common each of the ground plates together.

In a further embodiment, an electrical connector assembly is provided and includes a receptacle cage including cage walls forming a module channel configured to receive a pluggable module. The cage walls are configured to be mounted to a circuit board. The electrical connector assembly includes an electrical connector received in the receptacle cage for electrical connection to the pluggable module. The electrical connector is configured to be electrically connected to the circuit board. The electrical connector includes a housing having a cavity. The housing has a card slot at a mating end of the housing. The card slot is configured to receive a card edge of a circuit card of the pluggable module. The housing has a bottom configured to be mounted to a circuit board. The electrical connector includes a contact assembly received in the cavity. The contact assembly includes a contact module stack includes a plurality of signal contact modules and a plurality of ground contact modules. The ground contact modules provide electrical shielding for corresponding signal contact modules. Each signal contact module includes a signal leadframe having signal conductors and a dielectric body holding the signal conductors. Each signal conductor includes a transition portion extending between a mating end and a terminating end. The mating end of the signal conductor positioned in the housing at the card slot to interface with the circuit card. The terminating end of the signal conductor extends from the housing at the bottom for termination to the circuit board. Each ground contact module includes a ground leadframe having a ground plate and a dielectric body holding the ground plate. The ground leadframe extends between a mating end and a terminating end. The mating end of the leadframe is positioned in the housing at the card slot to interface with the circuit card. The terminating end of the ground leadframe extends from the housing at the bottom for termination to the circuit board. The ground plate includes skewer pockets and spring fingers extends into the corresponding skewer pocket. The electrical connector includes ground skewers extending across the contact module stack. The ground skewers are received in corresponding skewer pockets. The spring fingers engage the ground skewers to electrically connect the ground plate to the ground skewers. Each ground plate is coupled to each of the ground skewers. The ground skewers electrically commoning each of the ground plates together.

DETAILED DESCRIPTION OF THE INVENTION

Figure 1:
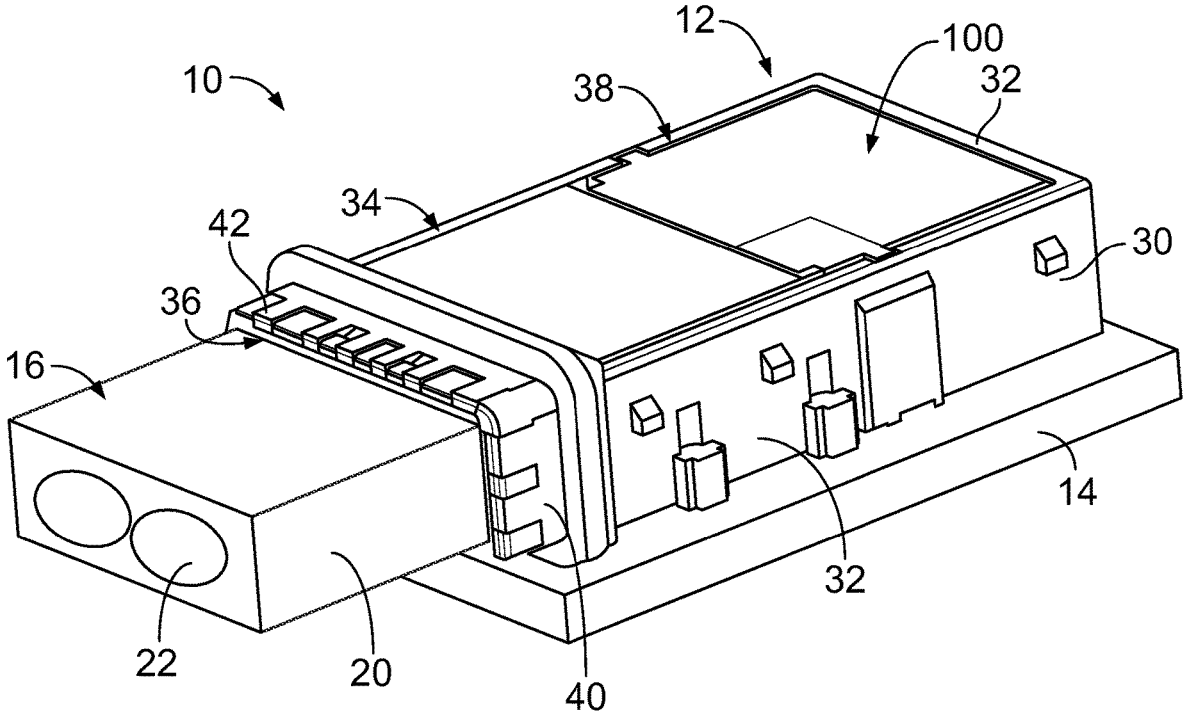
FIG. 1 is a perspective view of a connector system including an electrical connector assembly in accordance with an exemplary embodiment.

FIG. 1 is a perspective view of a connector system 10 including an electrical connector assembly 12 in accordance with an exemplary embodiment. The electrical connector assembly 12 is mounted to a circuit board 14. A pluggable module 16 is coupled to the electrical connector assembly 12. The electrical connector assembly 12 electrically connects the pluggable module 16 and the circuit board 14.

In an exemplary embodiment, the pluggable module 16 is an input/output connector, such as a transceiver module. The pluggable module 16 may be a circuit card connector having one or more circuit cards configured to be plugged into the electrical connector assembly 12. The pluggable module 16 includes a plug housing 20 holding a plurality of conductors, such as circuits on the circuit cards. In an exemplary embodiment, the pluggable module 16 is a dual circuit card pluggable module having an upper circuit card and a lower circuit card both configured to be plugged into the electrical connector assembly 12. The dual circuit card configuration has high signal density for high speed signaling and high signal throughput. In an exemplary embodiment, the pluggable module 16 is a cable connector provided at an end of a cable 22. Alternatively, the pluggable module 16 may be mounted to a circuit board. In other alternative embodiments, the pluggable module 16 is defined by a circuit card, such as a daughter card, which is configured to be directly plugged into the electrical connector assembly 12 without the plug housing 20.

The electrical connector assembly 12 includes a receptacle cage 30 and an electrical connector 100 received in the receptacle cage 30. The receptacle cage 30 includes cage walls 32 forming a module channel 34 that receives the pluggable module 16. For example, the cage walls 32 may include a top wall and/or a bottom wall and/or side walls and/or a rear wall and/or a front wall. In the illustrated embodiment, the receptacle cage 30 includes an opening 36 at the front configured to receive the pluggable module 16. In an exemplary embodiment, the receptacle cage 30 includes an opening 38 at the top configured to receive a heatsink to dissipate heat from the electrical connector 100 and/or the pluggable module 16. In an exemplary embodiment, the cage walls 32 are conductive to provide electrical shielding for the electrical connector 100 and the pluggable module 16. For example, the cage walls 32 may be stamped and formed from a metal material. Alternatively, the receptacle cage 30 may be a plated plastic structure with the plating material providing electrical shielding around the module channel 34. In an exemplary embodiment, an EMI gasket 40 is provided at the front to electrically connect the receptacle cage 30 to the pluggable module 16. The EMI gasket 40 includes a plurality of spring fingers 42 configured to engage the pluggable module 16. In an exemplary embodiment, a perimeter seal extends around the perimeter of the receptacle cage 30 proximate to the front of the receptacle cage 30. The seal may be sealed to another structure, such as a bezel or panel of the electrical component. In alternative embodiments, the electrical connector assembly 12 may be provided without the receptacle cage 30. For example, the electrical connector assembly 12 may include the electrical connector 100 mounted to the circuit board 14, which receives the pluggable module 16 without using the receptacle cage 30.

Figure 2:
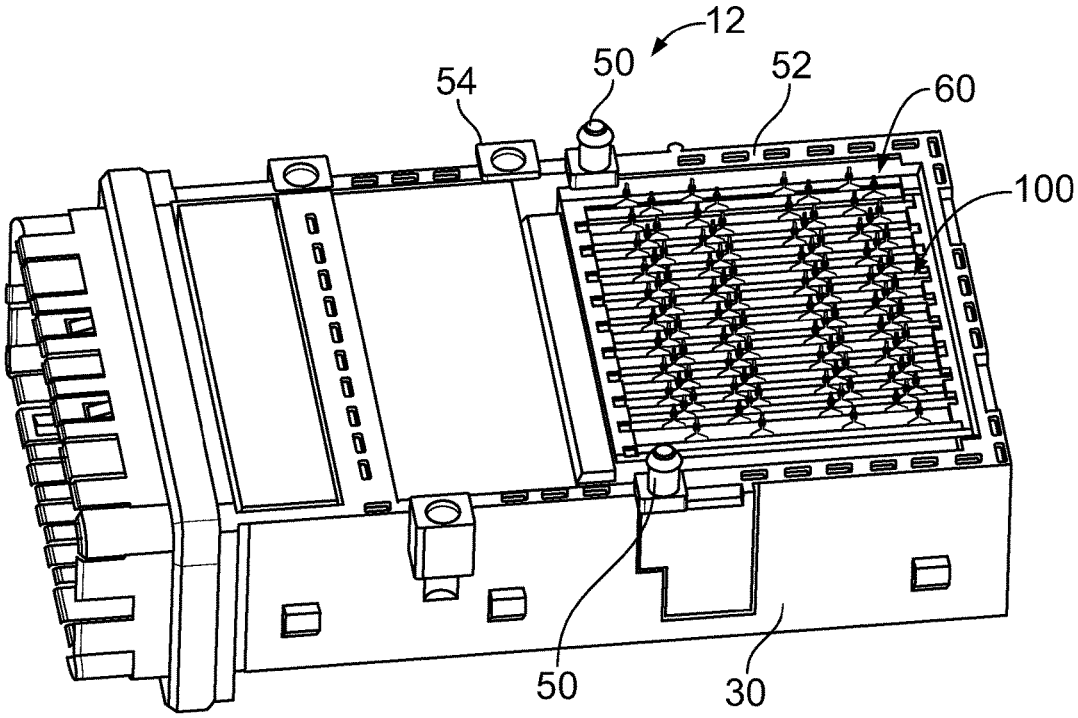
FIG. 2 is a bottom perspective view of the electrical connector assembly in accordance with an exemplary embodiment.

FIG. 2 is a bottom perspective view of the electrical connector assembly 12 in accordance with an exemplary embodiment. In an exemplary embodiment, the receptacle cage 30 includes guide posts 50 extending from a bottom 52 of the receptacle cage 30 the guide posts 50 are configured to be received in openings in the circuit board 14 (shown in FIG. 1) to locate the electrical connector assembly 12 relative to the circuit board 14. In the illustrated embodiment, the guide posts 50 are provided on opposite sides of the receptacle cage 30. Greater or fewer guide posts 50 may be used in alternative embodiments.

In an exemplary embodiment, the receptacle cage 30 includes mounting lugs 54 extending from the sides of the receptacle cage 30. The mounting lugs 54 receive fasteners, such as screws or other mounting hardware, to secure the receptacle cage 30 to the circuit board 14. In the illustrated embodiment, the mounting lugs 54 are provided at both sides of the receptacle cage 30. Greater or fewer mounting lugs 54 may be used in alternative embodiments.

In an exemplary embodiment, the receptacle cage 30 includes an opening 60 at the bottom 52. The electrical connector 100 is aligned with the opening 60. A portion of the electrical connector 100 extends through the opening 60 for mounting to the circuit board 14. For example, electrical contacts of the electrical connector 100 may extend through the opening 60 for termination to the circuit board 14. In the illustrated embodiment, the electrical connector 100 includes a plurality of press-fit pins at the bottom of the electrical connector 100 configured to be press-fit into openings or vias in the circuit board 14 for electrical connection of the electrical connector 100 to the circuit board 14.

Figure 3:
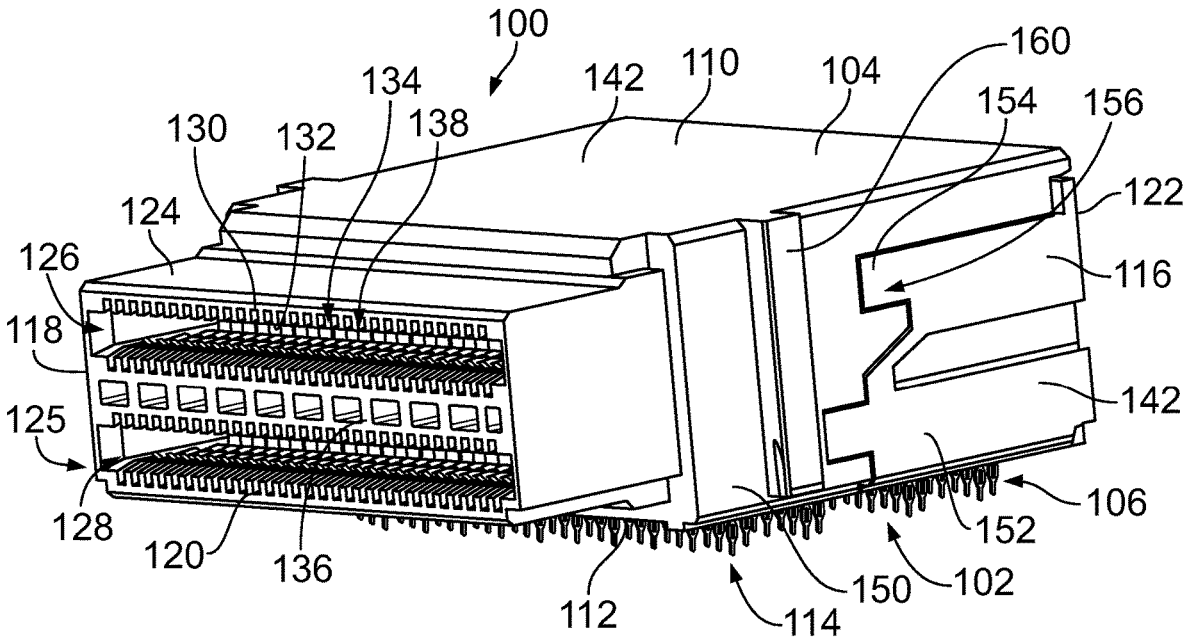
FIG. 3 is a front perspective view of the electrical connector in accordance with an exemplary embodiment.
Figure 4:
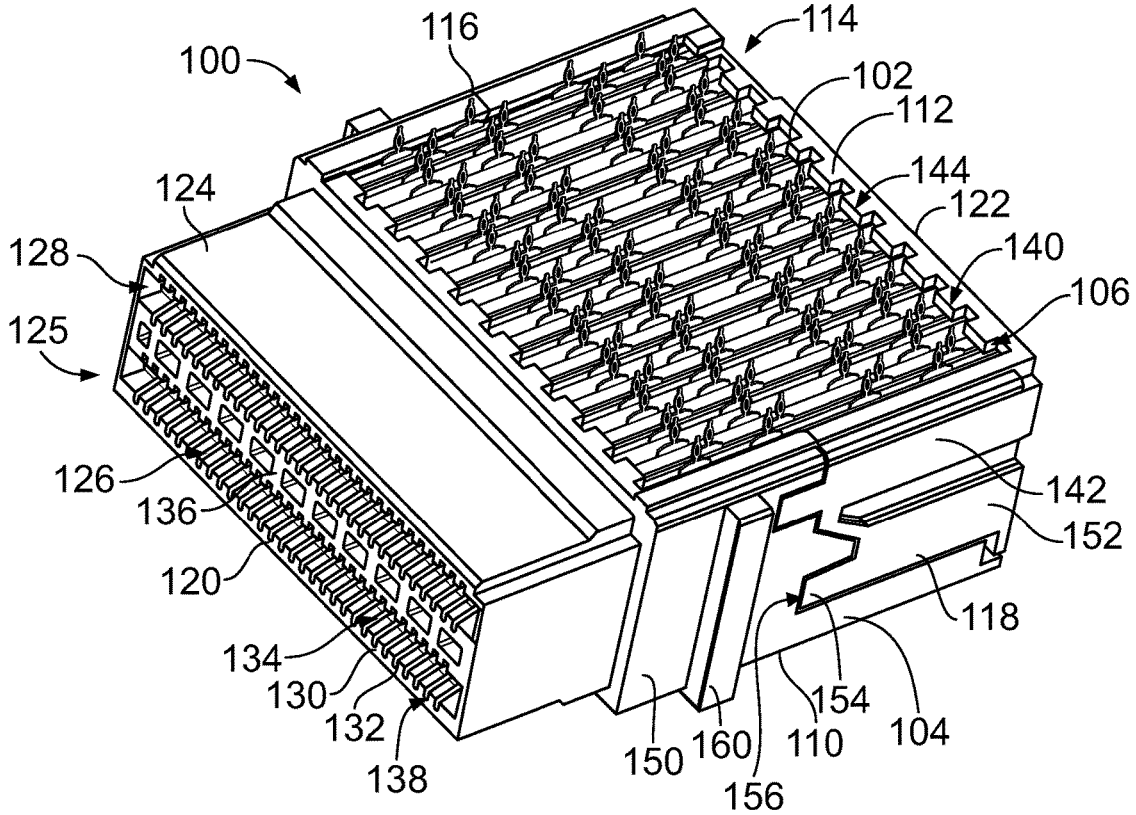
FIG. 4 is a bottom perspective view of the electrical connector in accordance with an exemplary embodiment.
Figure 5:
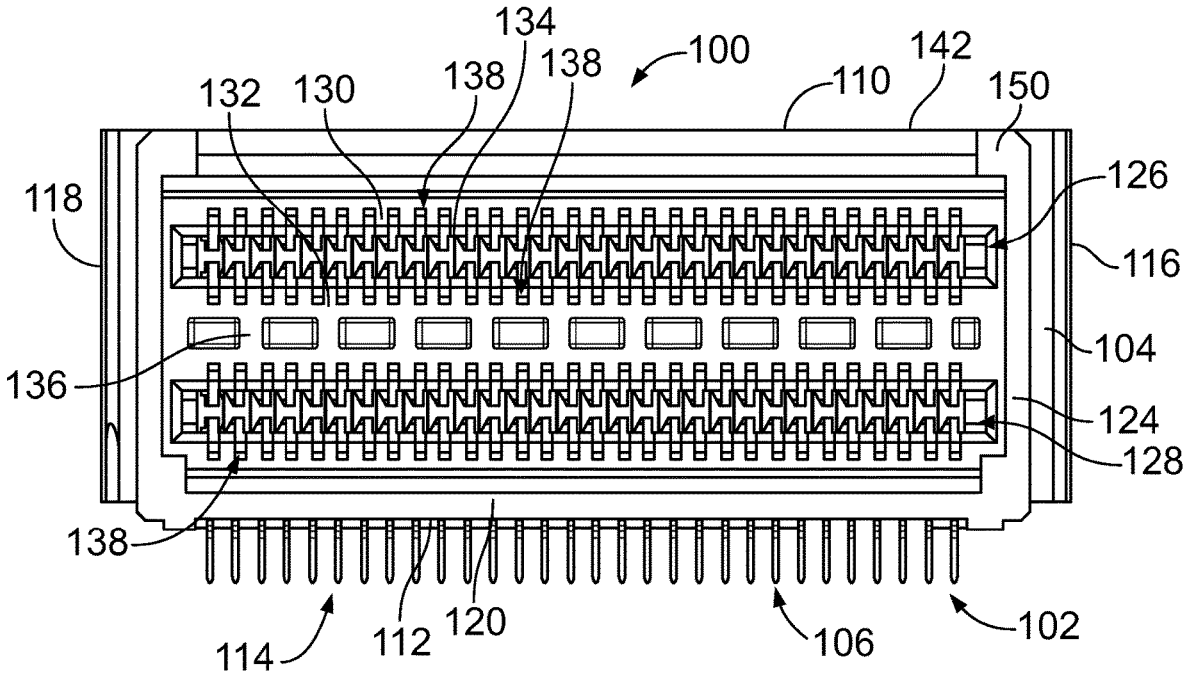
FIG. 5 is a front view of the electrical connector in accordance with an exemplary embodiment.

FIG. 3 is a front perspective view of the electrical connector 100 in accordance with an exemplary embodiment. FIG. 4 is a bottom perspective view of the electrical connector 100 in accordance with an exemplary embodiment. FIG. 5 is a front view of the electrical connector 100 in accordance with an exemplary embodiment.

The electrical connector 100 includes a contact assembly 102 received in a housing 104. The contact assembly 102 is configured to be electrically connected to the circuit board 14 (shown in FIG. 1). The contact assembly 102 is configured to be electrically connected to the pluggable module 16 (shown in FIG. 1). The contact assembly 102 includes a plurality of signal conductors configured to electrically connect the pluggable module 16 and the circuit board 14. In an exemplary embodiment, the contact assembly 102 includes a shield structure 106 used to provide electrical shielding for the signal conductors. The shield structure 106 electrically isolates certain signal conductors from other signal conductors to improve and enhance electrical performance of the electrical connector 100. For example, the shield structure 106 reduces crosstalk between various signal conductors.

The housing 104 includes a top 110 and a bottom 112 opposite the top 110. In an exemplary embodiment, the bottom 112 defines a mounting end 114 of the housing 104 configured to be mounted to the circuit board 14. The housing 104 includes a first side 116 and a second side 118 opposite the first side 116. The housing 104 extends between a front 120 and a rear 122. In an exemplary embodiment, the housing 104 includes a mating shroud 124 at the front 120. The mating shroud 124 defines a mating end 125 of the housing 104 configured for mating with the pluggable module 16. For example, the mating shroud 124 may be received in the pluggable module 16 when the pluggable module 16 is mated with the electrical connector 100. The mating end 125 is oriented generally perpendicular to the mounting end 114 defining the right angle connector. However, the mating end 125 may be provided at other locations in alternative embodiments, such as at the top 110 generally opposite the mounting end 114.

In an exemplary embodiment, the housing 104 includes at least one card slot at the front 120 configured to receive a circuit card of the pluggable module 16. In the illustrated embodiment, the housing 104 includes an upper card slot 126 and a lower card slot 128. The upper card slot 126 receives an upper circuit card of the pluggable module 16 and the lower card slot 128 receives a lower circuit card of the pluggable module 16. However, in an alternative embodiment, the housing 104 may include a single card slot or may include additional card slots.

In an exemplary embodiment, each card slot 126, 128 is defined by an upper wall 130 and a lower wall 132. The card slot 126, 128 has a gap 134 between the upper wall 130 and the lower wall 132 that receives the corresponding circuit card of the pluggable module 16. A separating wall 136 is provided between the upper card slot 126 and the lower card slot 128. The separating wall 136 defines the lower wall 132 for the upper card slot 126 and defines the upper wall 130 for the lower card slot 128. The conductors of the contact assembly 102 extend along the upper wall 130 and the lower wall 132 to interface with an upper surface and a lower surface of the circuit card received in the card slot 126, 128. In an exemplary embodiment, the housing 104 includes contact channels 138 in the upper wall 130 and in the lower wall 132. The contact channels 138 receive corresponding conductors of the contact assembly 102. The conductors are positioned in the contact channels 138 by separating walls between the contact channels 138. In an exemplary embodiment, the conductors are deflectable within the contact channels 138 to interface with the circuit card when the circuit card is received in the card slot 126, 128.

The housing 104 includes a cavity 140 that receives the contact assembly 102. The illustrated embodiment, the cavity 140 is at least partially enclosed by a plurality of walls 142 of the housing 104. For example, the housing 104 includes an upper wall at the top 110, a lower wall at the bottom 112, first and second side walls at the first and second sides 116, 118, a front wall at the front 120, and a rear wall at the rear 122. The card slots 126, 128 are open at the front 120 to the cavity 140. In an exemplary embodiment, the housing 104 includes an opening 144 at the bottom 112. Portions of the contact assembly 102 extend through the opening 144 beyond the bottom 112, such as for mounting to the circuit board 14. The housing 104 may include greater or fewer walls 142 in alternative embodiments.

In an exemplary embodiment, the housing 104 is a multipiece housing. For example, the housing 104 includes a front housing 150 and a rear housing 152. The rear housing 152 is coupled to the front housing 150 to form the cavity 140 and retain the contact assembly 102 in the housing 104. In an exemplary embodiment, the rear housing 152 includes mating tabs 154 extending into pockets 156 in the front housing 150 to position and secure the rear housing 152 to the front housing 150. The front housing 150 may additionally or alternatively include the mating tabs 154. Optionally, the mating tabs 154 may include crush ribs or other features to create an interference fit of the mating tabs 154 in the pockets 156 to provide mechanical retention of the rear housing 152 to the front housing 150. Other securing features may be provided in alternative embodiments, such as fasteners, clips, latches, and the like.

In an exemplary embodiment, the housing 104 includes locating tabs 160 extending from the housing 104 to locate the housing 104 in the receptacle cage 30 (shown in FIG. 2). In the illustrated embodiment, the locating tabs 160 are provided at the first and second sides 116, 118. The locating tabs 160 extend vertically and guide loading of the electrical connector 100 into the receptacle cage 30 in a vertical loading direction. The locating tabs 160 may have other orientations or be located at other locations in alternative embodiments. Other types of locating features may be used in alternative embodiments to locate the electrical connector 100 within the receptacle cage 30. The housing 104 may include securing features, such as latches, barbs, ribs or other features to mechanically retain the electrical connector 100 in the receptacle cage 30.

Figure 6:
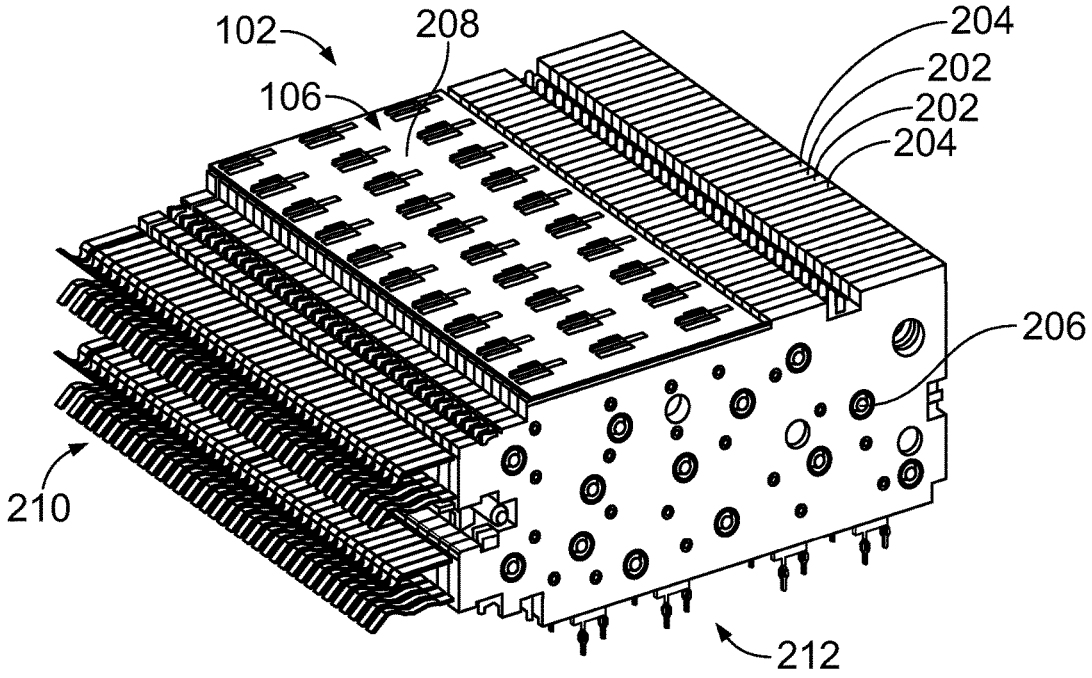
FIG. 6 is a front perspective view of the contact assembly in accordance with an exemplary embodiment.

FIG. 6 is a front perspective view of the contact assembly 102 in accordance with an exemplary embodiment. The contact assembly 102 includes a plurality of contact modules arranged in a contact module stack 200. For example, the contact assembly 102 includes a plurality of signal contact modules 202 and a plurality of ground contact modules 204 arranged in the contact module stack 200. In an exemplary embodiment, the contact modules are arranged in a ground-signal-signal-ground arrangement (for example, G-S-S-G-S-S-G . . . ). Other arrangements are possible in alternative embodiments, such as having a single signal contact module 202 arranged between ground contact modules 204 or having greater than to signal contact modules 202 arranged between ground contact modules 204. The ground contact modules 204 provide electrical shielding for the signal contact modules 202.

In an exemplary embodiment, the shield structure 106 of the contact assembly 102 is defined by the ground contact modules 204, ground skewers 206 extending through the contact module stack 200 and a commoning plate 208 extending along the contact module stack 200. The shield structure 106 may include other elements in alternative embodiments. The elements of the shield structure 106 are electrically commoned at multiple points of contact to provide a reliable shield structure 106 for the contact assembly 102. The ground skewers 206 pass through the signal contact modules 202 to electrically connect each of the ground contact modules 204. In an exemplary embodiment, each ground skewer 206 has a width greater than or equal to a width of the contact module stack 200. The ground skewers 206 thus define internal ground paths through the contact module stack 200. The commoning plate 208 extends along the exterior of the contact module stack 200, such as along the top of the contact module stack 200, to electrically connect each of the ground contact modules 204. The commoning plate 208 may be provided at other locations in alternative embodiments, such as along the bottom or along the rear of the contact module stack 200. Optionally, multiple commoning plates 208 may be utilized. The commoning plate 208 defines an external ground path for the contact module stack 200. The busing or commoning of the ground contact modules 204 increases the resonance frequencies to a frequency beyond a frequency of interest for the electrical connector 100 (for example, above 16 GHz).

The contact modules 202, 204 of the contact module stack 200 have a mating interface 210 configured for mating with the pluggable module 16 (shown in FIG. 1). In the illustrated embodiment, the mating interface 210 is provided at the front of the contact module stack 200. In an exemplary embodiment, the contact modules 202, 204 include a plurality of spring beams at the mating interface 210 configured to interface with the circuit cards of the pluggable module 16. Other types of contact interfaces may be provided in alternative embodiments, such as pins, sockets, and the like. The contact modules 202, 204 of the contact module stack 200 have a mounting interface 212 configured for mounting to the circuit board 14 (shown in FIG. 1). In the illustrated embodiment, the mounting interface 212 is provided at the bottom of the contact module stack 200. In an exemplary embodiment, the contact modules 202, 204 include a plurality of press-fit pins at the mounting interface 212 configured to interface with the circuit board 14. Other types of contact interfaces may be provided in alternative embodiments, such as solder tails. The mating interface 210 is oriented generally perpendicular to the mounting interface 212. The contact modules 202, 204 form right angle contact modules in the illustrated embodiment. Other orientations are possible in alternative embodiments, such as having the mating interface 210 at the top of the contact module stack 200 or having the mounting interface 212 at the rear of the contact module stack 200.

Figure 7:
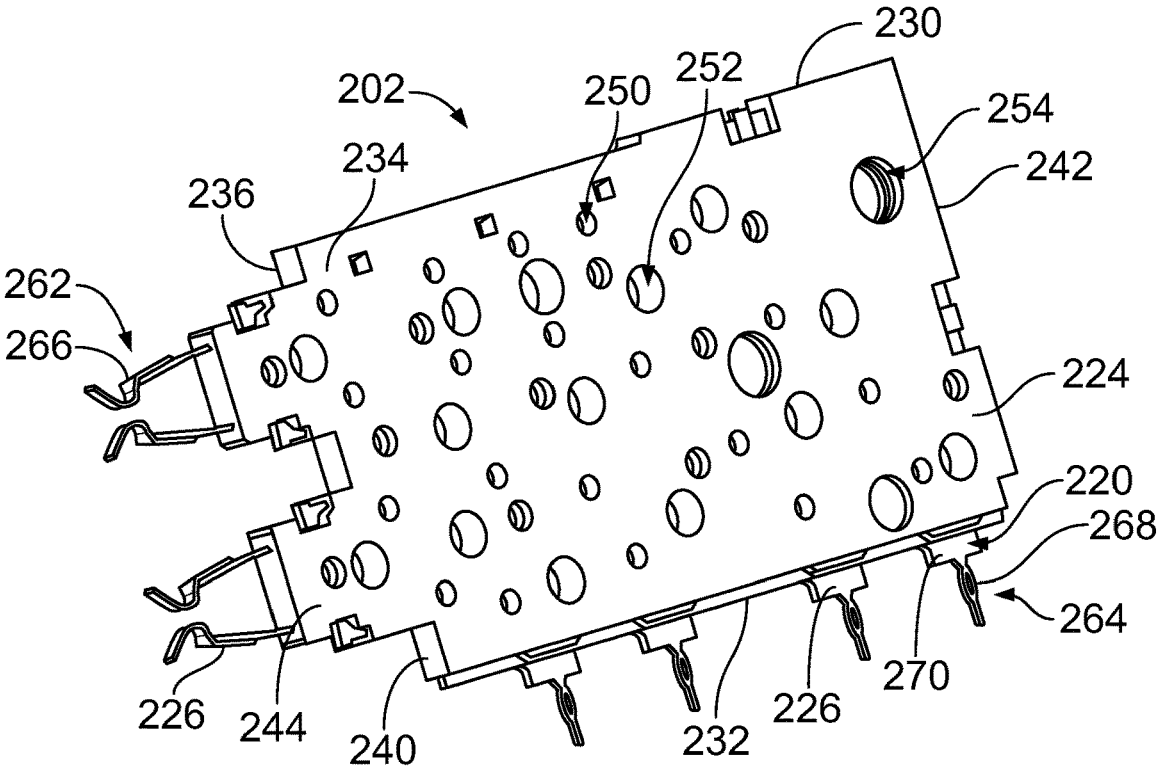
FIG. 7 is a front perspective view of the signal contact module in accordance with an exemplary embodiment.
Figure 8:
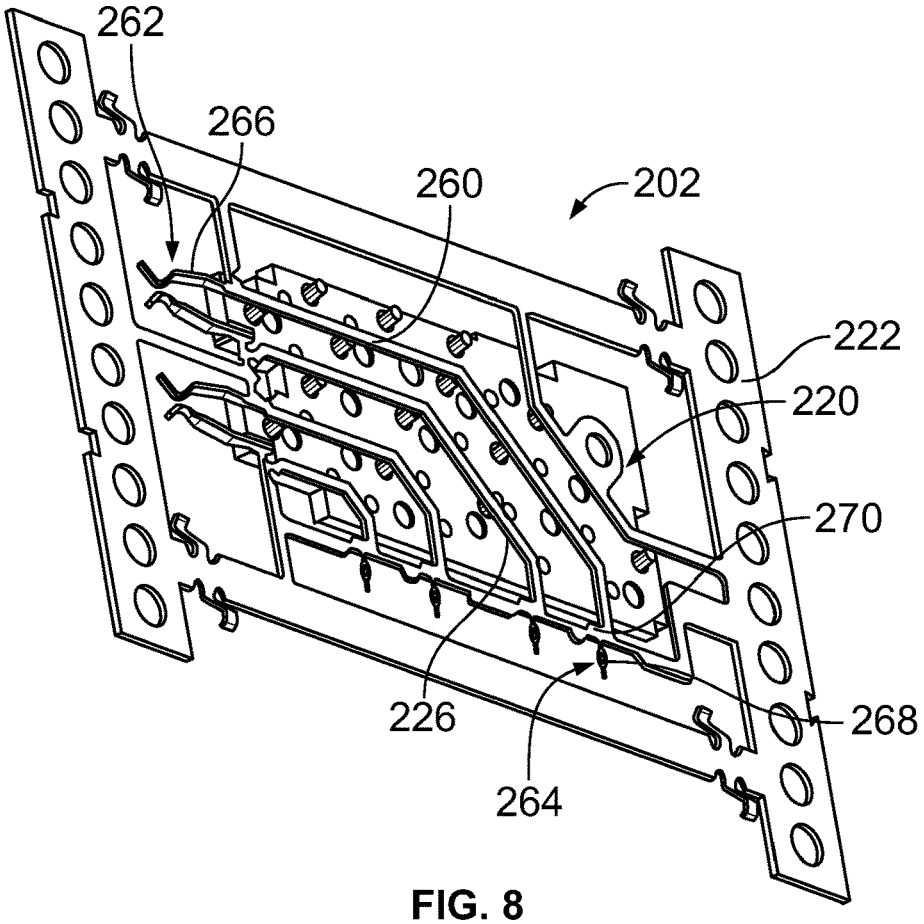
FIG. 8 is a front perspective view of a portion of the signal contact module in accordance with an exemplary embodiment.

FIG. 7 is a front perspective view of the signal contact module 202 in accordance with an exemplary embodiment. FIG. 8 is a front perspective view of a portion of the signal contact module 202 in accordance with an exemplary embodiment showing a signal leadframe 220 of the signal contact module 202 on a carrier 222, which is configured to be removed during manufacture. The signal contact module 202 includes a dielectric body 224 (shown in FIG. 7) surrounding signal conductors 226 of the signal leadframe 220. In an exemplary embodiment, the dielectric body 224 is overmolded over the signal leadframe 220 during manufacture. The signal contact module 202 may be manufactured using other processes in alternative embodiments, such as stitching or loading contacts into a preformed dielectric body.

The dielectric body 224 includes a top edge 230 and a bottom edge 232 opposite the top edge 230. The dielectric body 224 includes a first side 234 and a second side 236 opposite the first side 234. Optionally, the first and second sides 234, 236 may be planar and parallel to each other. The dielectric body 224 includes a front edge 240 and a rear edge 242 opposite the front edge 240. In an exemplary embodiment, the dielectric body 224 includes extensions 244 extending forward from the front edge 240. The extensions 244 are configured to be plugged into the card slots 126, 128 (shown in FIG. 3).

In an exemplary embodiment, the dielectric body 224 includes conductor openings 250 that provide access to the signal conductors 226 of the signal leadframe 220. The conductor openings 250 may be formed in the dielectric body 224 during the overmolded process by pinch points or pinched fingers that are used to position and hold the signal conductors 226 of the signal leadframe 220 during the overmolded process. The conductor openings 250 expose the signal conductors 226 to air, which may be used for impedance control, such as by controlling the size and shape of the conductor openings 250.

In an exemplary embodiment, the dielectric body 224 includes skewer openings 252 passing through the dielectric body 224. The skewer openings 252 are configured to receive the ground skewers 206 (shown in FIG. 6). The skewer openings 252 are located between the various signal conductors 226 of the signal leadframe 220. In an exemplary embodiment, no portions of the signal conductors 226 are exposed within the skewer openings 252. The dielectric body 224 is located between the skewer openings 252 and the signal conductors 226 to electrically isolate the signal conductors 226 from the ground skewers 206. In the illustrated embodiment, the skewer openings 252 are cylindrical. The skewer openings 252 may have other shapes in alternative embodiments.

In an exemplary embodiment, the dielectric body 224 includes one or more locating openings 254 passing through the dielectric body 224. The locating openings 254 are used to locate the signal contact module 202 during assembly. For example, all of the contact modules in the contact module stack 200 may have the locating openings 254 aligned at, locations to receive a locating feature, such as a post to orient the contact modules relative to each other during assembly.

The signal leadframe 220 includes a plurality of the signal conductors 226. In an exemplary embodiment, the signal conductors 226 may be arranged in pairs. For example, in the illustrated embodiment, the signal leadframe 220 includes an upper pair and a lower pair. The signal leadframe 220 may include greater or fewer pairs in alternative embodiments. The signal conductors 226 within the pair may be configured to convey differential signals. Alternatively, the signal conductors 226 may be paired with signal conductors from an adjacent signal contact module 202 to convey differential signals. In other alternative embodiments, the signal conductors 226 may be single ended conductors rather than conveying differential signals.

Each signal conductor 226 includes a transition portion 260 extending between a mating end 262 and a terminating end 264. In an exemplary embodiment, the mating end 262 and the terminating end 264 are perpendicular to each other forming a right angle signal conductor. The transition portion 260 transitions between the mating end 262 and a terminating end 264 through one or more bends, curves, or angles to form the generally right angle signal conductor.

In the illustrated embodiment, each signal conductor 226 includes a spring beam 266 at the mating end 262. In the illustrated embodiment, each signal conductor 226 includes a compliant pin 268, such as a press-fit pin or an eye-of-the-needle pin, at the terminating end 264. The spring beam 266 is configured to interface with the circuit card of the pluggable module 16. The compliant pin 268 is configured to be press-fit into a corresponding plated via in the circuit board 14. Other types of contacts structures may be provided at the mating end 262 and/or the terminating end 264 in alternative embodiments.

In an exemplary embodiment, the spring beam 266 at the mating end 262 is bent at a right angle compared to the transition portion 260. For example, the broadside of the spring beam 266 is oriented perpendicular with respect to the broad side of the transition portion 260 to provide a larger surface area at the mating end 262 for interfacing with the circuit card. The mating end 262 extends from the dielectric body 224. For example, the mating end 262 extends forward from the extension 244 at the front of the dielectric body 224. The spring beam 266 at the mating end 262 includes a curved mating interface for interfacing with the circuit card. In an exemplary embodiment, the pairs of spring beams 266 are configured to be arranged on opposite sides of the card slot 126, 128 to engage upper and lower surfaces of the circuit card.

In an exemplary embodiment, the terminating end 264 extends from the dielectric body 224. For example, the terminating end 264 extends downward from the bottom edge 232 of the dielectric body 224. The compliant pin 268 at the terminating end 264 extends from a pad 270 at the bottom of the transition portion 260. For optionally, the compliant pin 268 may be offset or off-center relative to the pad 270. For example, the compliant pin 268 may be located rearward or forward relative to the center of the pad 270. Optionally, compliant pins of different signal contact modules 202 may be offset in different directions, such as to stagger the relative locations of the compliant pins 268. For example, all of the compliant pins 268 of one signal contact module 202 may be shifted forward while all of the compliant pins 268 of the adjacent signal contact module 202 may be shifted rearward.

Figure 9:
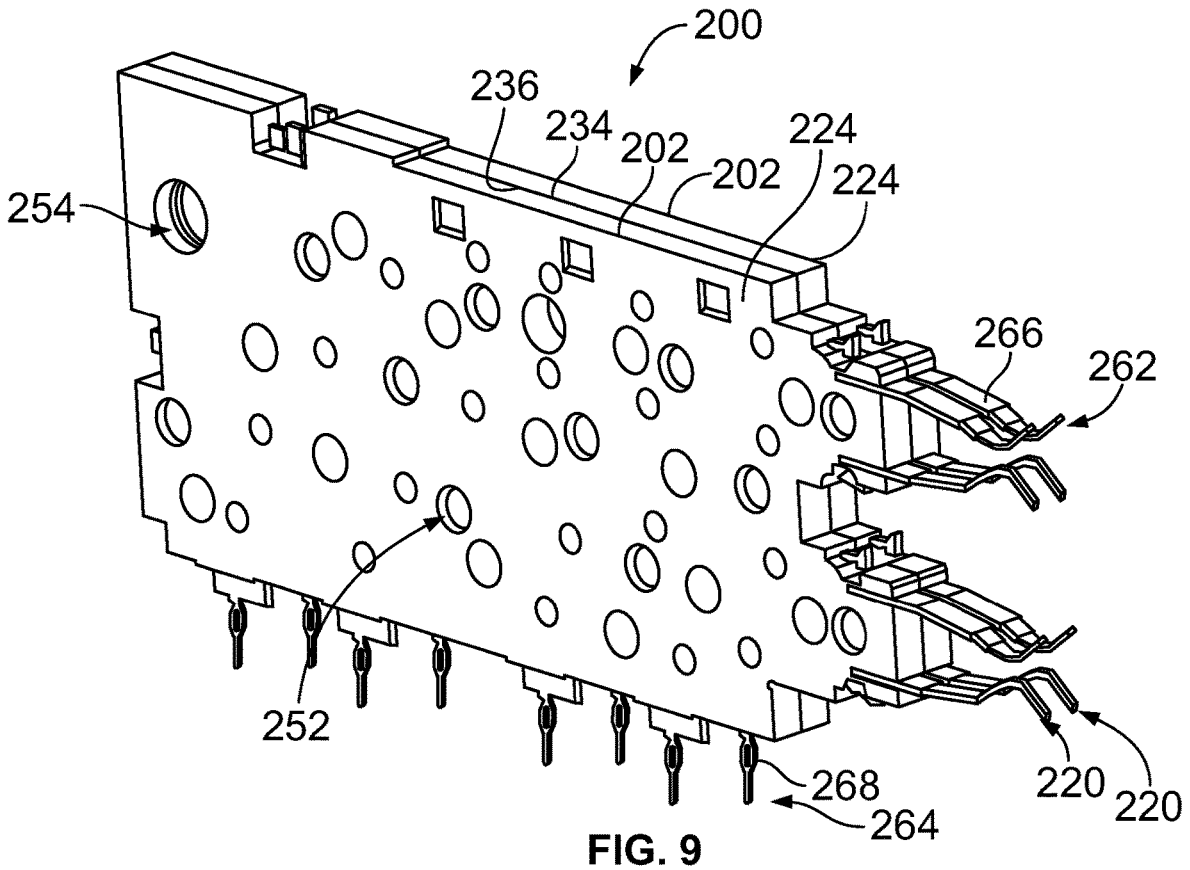
FIG. 9 is a front perspective view of a portion of the contact module stack showing a pair of the signal contact modules stacked adjacent to each other in accordance with an exemplary embodiment.

FIG. 9 is a front perspective view of a portion of the contact module stack 200 showing a pair of the signal contact modules 202 stacked adjacent to each other. The signal contact modules 202 form a signal contact modules pair, which may be flanked on both sides by corresponding ground contact modules 204 (shown in FIG. 10).

The sides 234, 236 of the signal contact modules 202 abut against each other at an interface. The skewer openings 252 are aligned with each other to receive the ground skewers 206 (shown in FIG. 10). The locating openings 254 are aligned with each other to receive a locating post (not shown), which is used during assembly to position all of the contact modules within the contact module stack 200. The locating openings 254 define the datum openings for the signal contact modules 202.

The dielectric bodies 224 position the signal leadframes 220 relative to each other. The thicknesses of the dielectric bodies 224 controls spacing between the signal leadframes 220. The mating ends 262 of the signal leadframes 220 are oriented parallel to each other. In an exemplary embodiment, the spring beams 266 are parallel to each other and configured to interface with opposite sides of the circuit cards plugged into the upper and lower card slots. The terminating ends 264 of the signal leadframes 220 are oriented parallel to each other. In an exemplary embodiment, the compliant pins 268 are offset or staggered relative to each other. For example, the compliant pins 268 of one of the signal contact modules 202 are shifted forward while the compliant pins 268 of the other signal contact module 202 are shifted rearward.

Figure 10:
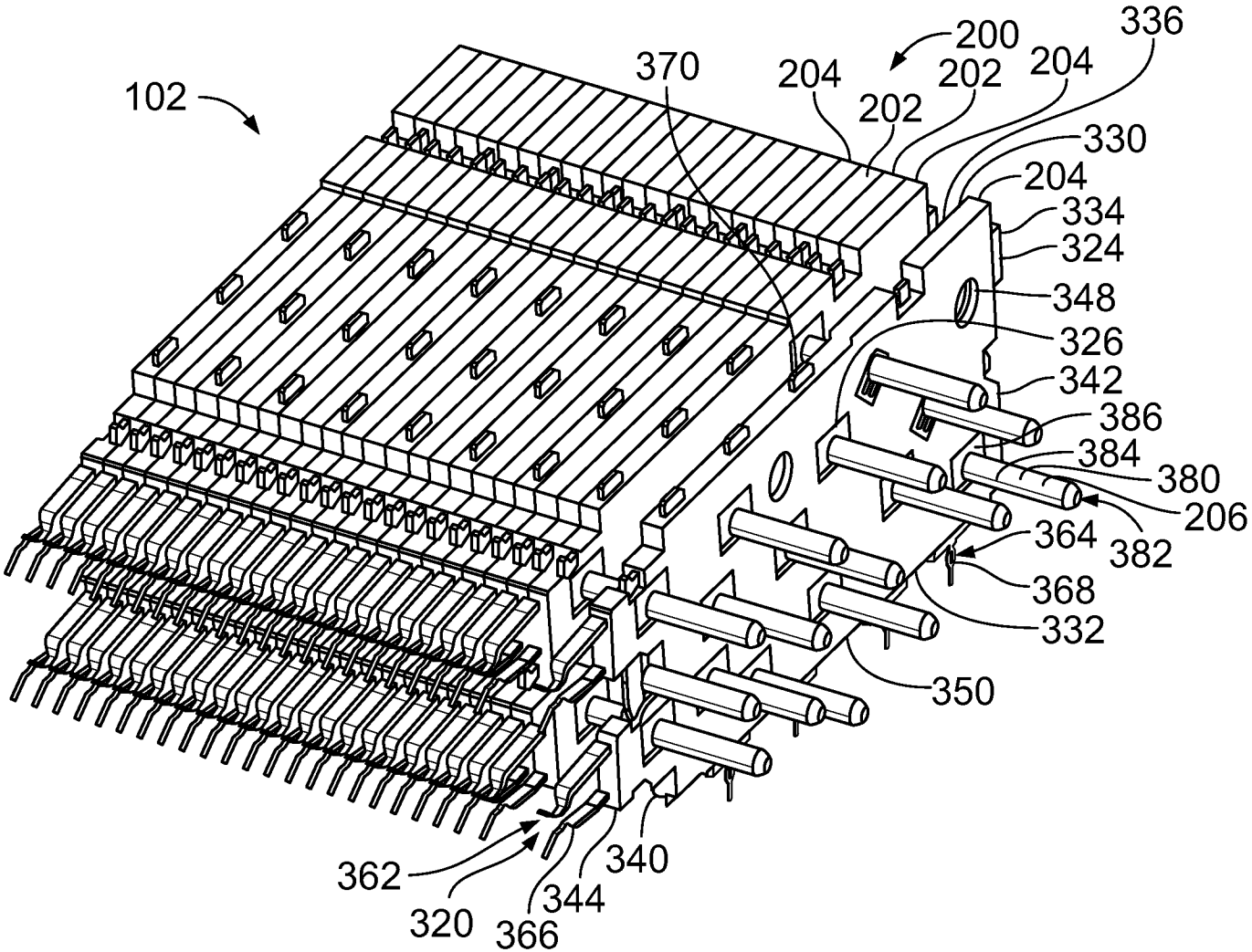
FIG. 10 is a front perspective view of a portion of the contact assembly showing a plurality of the signal contact modules and the ground contact modules arranged in the contact module stack in accordance with an exemplary embodiment.
Figure 11:
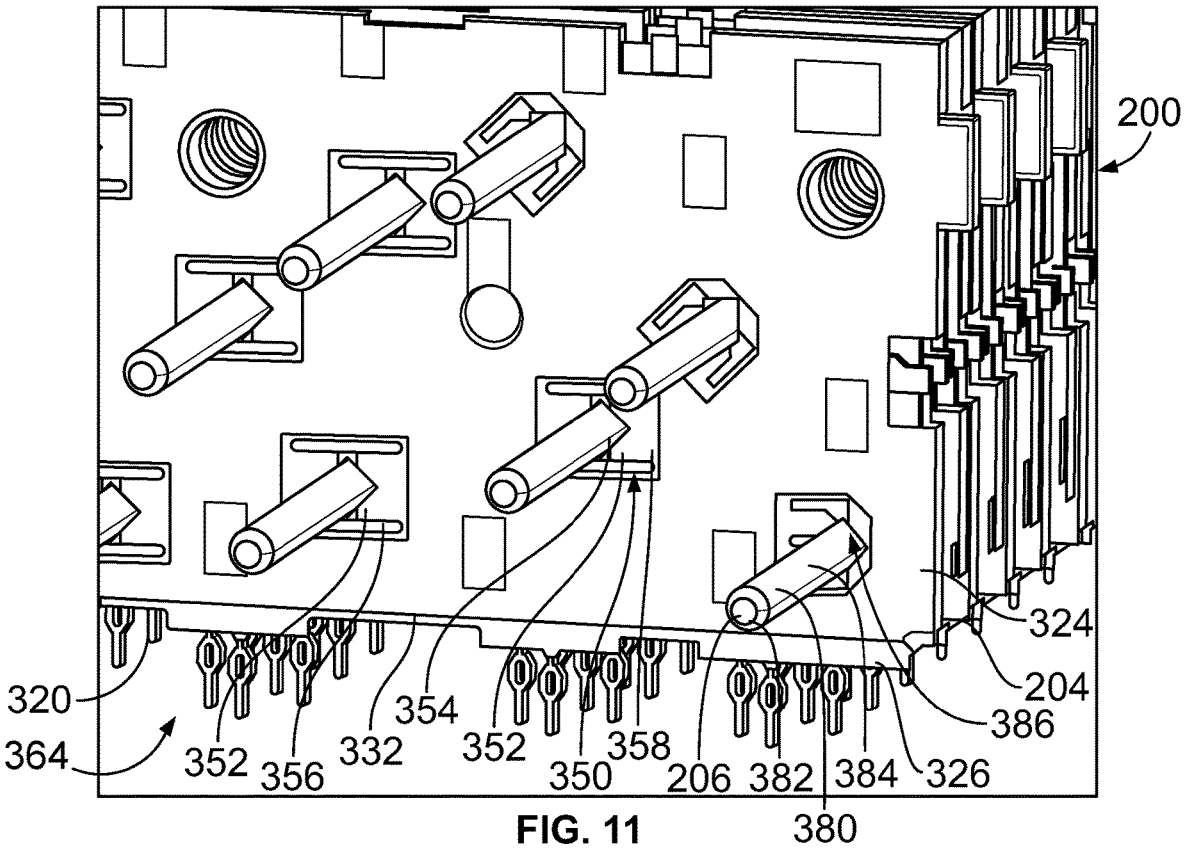
FIG. 11 is a side perspective view of a portion of the contact assembly showing a plurality of the signal contact modules and the ground contact modules arranged in the contact module stack in accordance with an exemplary embodiment.
Figure 12:
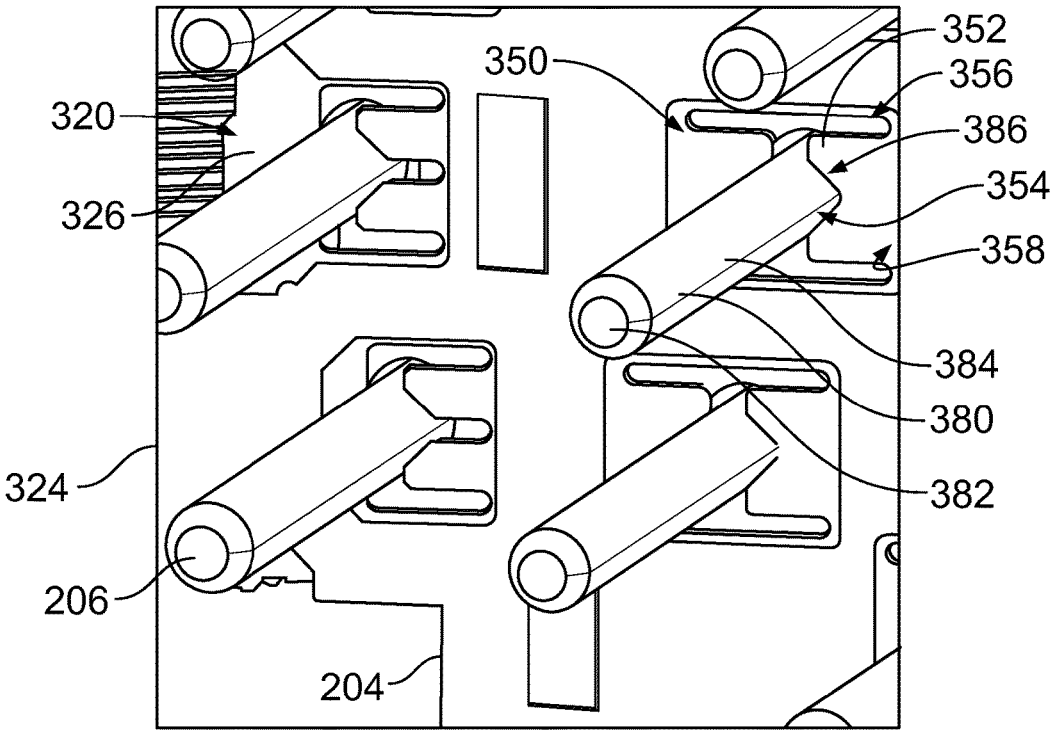
FIG. 12 is a side view of a portion of the contact assembly in accordance with an exemplary embodiment.

FIG. 10 is a front perspective view of a portion of the contact assembly 102 showing a plurality of the signal contact modules 202 and the ground contact modules 204 arranged in the contact module stack 200. FIG. 11 is a side perspective view of a portion of the contact assembly 102 showing a plurality of the signal contact modules 202 and the ground contact modules 204 arranged in the contact module stack 200. FIG. 12 is a side view of a portion of the contact assembly 102. The ground skewers 206 are illustrated in FIGS. 10-12 passing through the signal contact modules 202 and the ground contact modules 204. The ground skewers 206 are used to electrically connect each of the ground contact modules 204 together to electrically common the ground contact modules 204. The ground skewers 206 provide internal grounding of the ground contact modules 204.

The ground contact module 204 includes a ground leadframe 320 and a dielectric body 324 surrounding the ground leadframe 320. The ground leadframe 320 includes a ground plate 326, which may be divided into separate ground conductors similar to the signal leadframe. In an exemplary embodiment, the dielectric body 324 is overmolded over the ground leadframe 320 during manufacture. The dielectric body 324 may flow through the ground plate 326 during the molding process and extends along both sides of the ground plate 326. The ground contact module 204 may be manufactured using other processes in alternative embodiments.

The dielectric body 324 include a top edge 330 and a bottom edge 332 opposite the top edge 330. The dielectric body 324 includes a first side 334 and a second side 336 opposite the first side 334. Optionally, the first and second sides 334, 336 may be planar and parallel to each other. The dielectric body 324 includes a front edge 340 and a rear edge 342 opposite the front edge 340. In an exemplary embodiment, the dielectric body 324 includes extensions 344 extending forward from the front edge 340. The extensions 344 are configured to be plugged into the card slots 126, 128 (shown in FIG. 3).

In an exemplary embodiment, the dielectric body 324 includes one or more locating openings 348 passing through the dielectric body 324. The locating openings 348 are used to locate the ground contact module 204 during assembly. For example, all of the contact modules in the contact module stack 200 may have the locating openings 348 aligned at, locations to receive a locating feature, such as a post to orient the contact modules relative to each other during assembly.

In an exemplary embodiment, the dielectric body 324 includes skewer openings 350 passing through the dielectric body 324. The skewer openings 350 are aligned with the skewer openings 252 (shown in FIG. 9). The skewer openings 350 are configured to receive the ground skewers 206 (shown in FIG. 6). In an exemplary embodiment, portions of the ground plate 326 are exposed in the skewer openings 350. The ground plate 326 includes spring fingers 352 arranged adjacent to skewer pockets 354 that receive the ground skewers 206. The spring fingers 352 are exposed in the skewer openings 350. The skewer pockets 354 are exposed in the skewer openings 350. The spring fingers 352 may be stamped and formed from the ground plate 326 being separated from the ground plate 326 by gaps 356 formed during the stamping process. The spring fingers 352 are connected to the ground plate 326 at fixed ends 358. For example, the spring fingers 352 may be hingedly coupled to the ground plate 326 at the fixed ends 358. The spring fingers 352 are cantilevered from the ground plate 326 and extend to distal ends configured to engage the ground skewers 206. The spring fingers 352 define the skewer pockets 354, such as being arranged on opposite sides of the skewer pocket 354 to engage the ground skewers 206 when the ground skewers 206 are received in the skewer pockets 354. The spring fingers 352 may have cutouts or indentions forming the skewer pockets 354. The spring fingers 352 are deflectable relative to the ground plate 326 to engage the ground skewers 206. For example, the spring fingers 352 may be deflected outward when the ground skewers 206 are loaded into the skewer pockets 354. Once deflected, the spring fingers 352 are spring biased against the ground skewer 206 to mechanically and electrically connect the ground plate 326 to the ground skewers 206.

The ground plate 326 includes contact elements at a mating end 362 and a terminating end 364 of the ground leadframe 320. In an exemplary embodiment, the mating end 362 and the terminating end 364 are perpendicular to each other forming a right angle ground conductor. In the illustrated embodiment, the ground leadframe 320 includes spring beams 366 at the mating end 362 and compliant pins 368 at the terminating end 364. The spring beams 366 are configured to interface with the circuit card of the pluggable module 16. The spring beams 366 extend forward from the extension 344 at the front of the dielectric body 324. The compliant pins 368 extend downward from the bottom edge 332 of the dielectric body 324. The compliant pins 368 are configured to be press-fit into a corresponding plated via in the circuit board 14. Other types of contacts structures may be provided at the mating end 362 and/or the terminating end 364 in alternative embodiments.

In an exemplary embodiment, the ground plate 326 includes ground fins 370 extending from the dielectric body 324. The ground fins 370 are located at the top edge 330 in the illustrated embodiment, the ground fins 370 are configured to be coupled to the commoning plate 208 (shown in FIG. 6). For example, the ground fins 370 may pass through openings in the commoning plate 208. The ground fins 370 may include bumps or protrusions configured to engage the commoning plate 208. Alternatively, the commoning plate 208 may include bumps or protrusions extending into the openings to engage the ground fins 370. In the illustrated embodiment, each ground plate 326 includes a plurality of the ground fins 370. The ground fins 370 may additionally or alternatively be located at other locations, such as the rear or the bottom of the ground contact module 204. The commoning plate 208 is configured to be coupled to each of the ground contact modules 204 to electrically common each of the ground plates 326.

The ground skewer 206 is manufactured from a conductive material, such as a metal material. The ground skewer 206 is electrically conductive to electrically connect the ground plates 326 of the ground contact modules 204. The ground skewers 206 include cylindrical posts 380 extending between opposite ends 382. The ends 382 may be chamfered to guide loading through the contact modules 202, 204. The posts 380 may be solid metal posts. Alternatively, the posts 380 may be stamped and formed into the cylindrical shape. The ground skewer 206 has an exterior surface 384. The exterior surface 384 is configured to engage the ground plates 326 of the ground contact modules 204. The ground skewer 206 includes a plurality of contact points 386 along the exterior surface 384. The contact points 386 may be spaced apart at different axial locations along the ground skewer 206. The ground skewers 206 electrically common each of the ground contact modules 204. In an exemplary embodiment, the contact assembly 102 includes a plurality of the ground skewers 206 to provide multiple points of contact between each of the ground contact modules 204.

Figure 13:
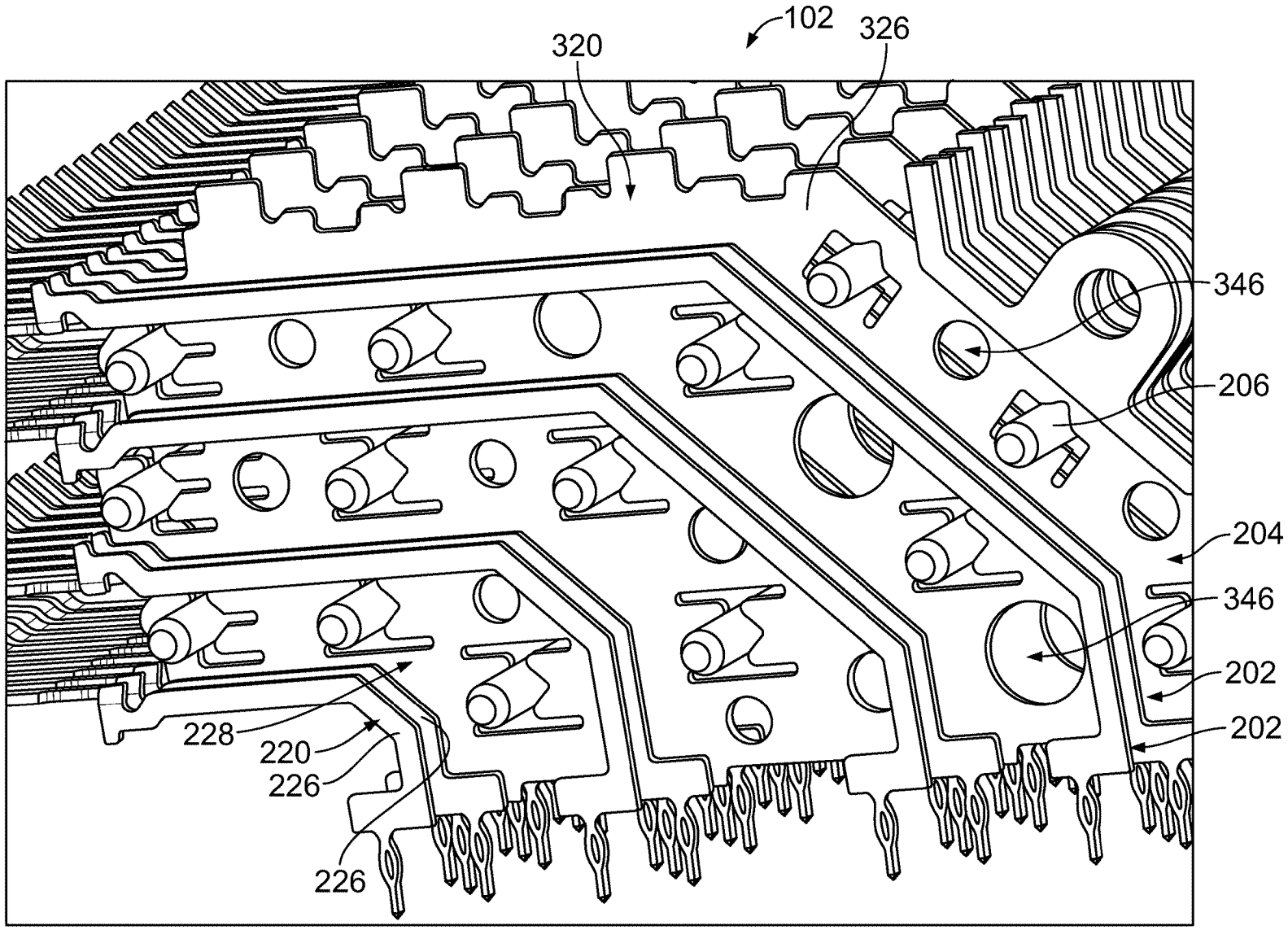
FIG. 13 is a side view of a portion of the contact assembly in accordance with an exemplary embodiment.

FIG. 13 is a side view of a portion of the contact assembly 102 in accordance with an exemplary embodiment showing the ground skewers 206 passing through the signal contact modules 202 and the ground contact modules 204. The signal contact modules 202 and the ground contact modules 204 are shown with the dielectric bodies 224, 324 removed to illustrate the signal leadframes 220 and the ground leadframes 320. Gaps 228 are defined between the signal conductors 226. The ground skewers 206 are aligned with the gaps 228. The ground skewers 206 pass through the gaps 228 between the signal conductors 226. The ground skewers 206 are spaced apart from the signal conductors 226 to prevent electrical shorting.

The ground plates 326 form shield walls between the pairs of signal conductors 226. The ground plates 326 provide electrical shielding between the signal contact module pairs. The ground skewers 206 electrically connect the ground plates 326. In an exemplary embodiment, the ground plates 326 include openings 346 therethrough. The openings 346 allow the material forming the dielectric body 324 to flow through the ground plate 326 during the molding process.

Figure 14:
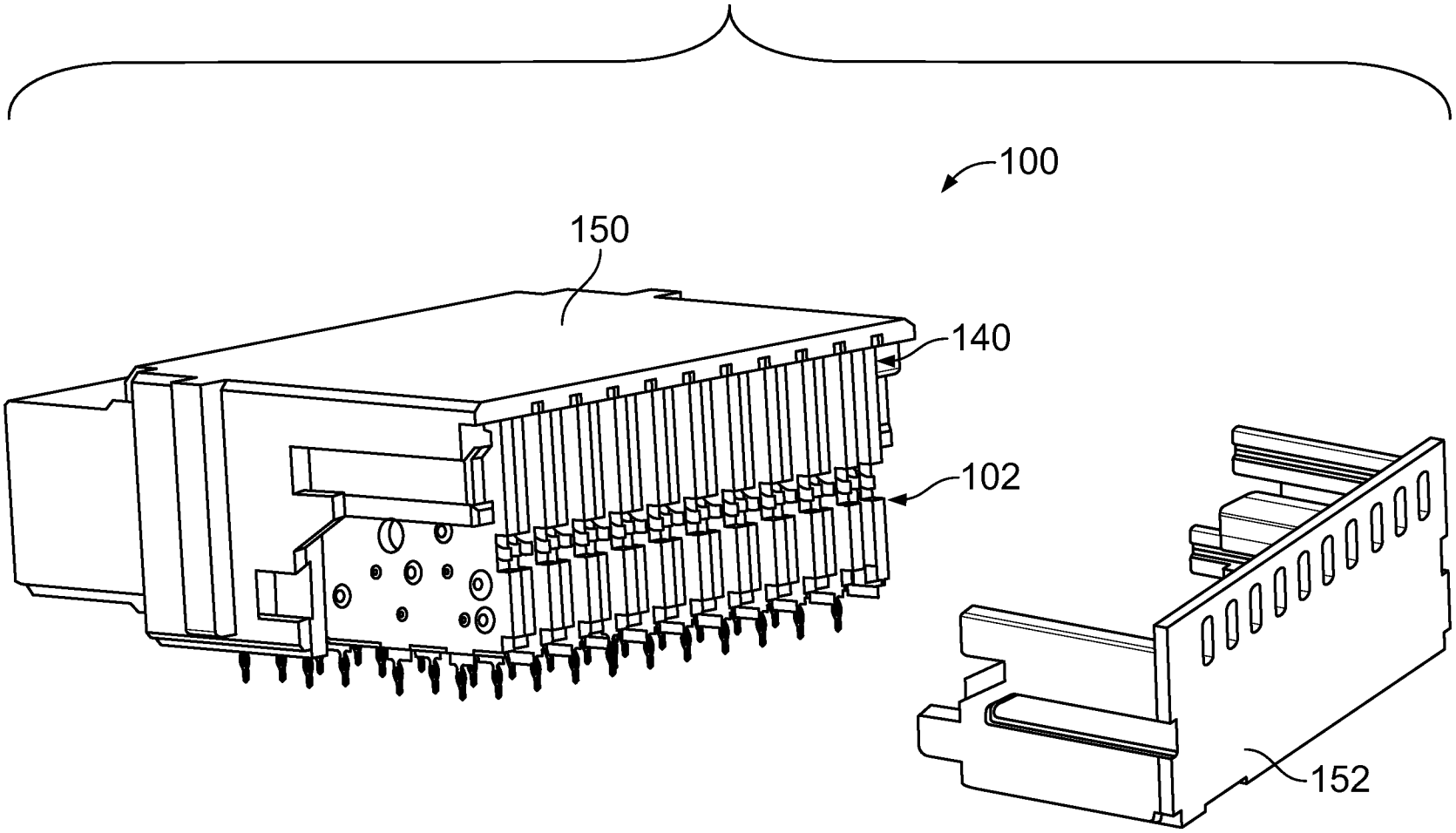
FIG. 14 is a rear, exploded perspective view of the electrical connector in accordance with an exemplary embodiment.

FIG. 14 is a rear, exploded perspective view of the electrical connector 100 in accordance with an exemplary embodiment. During assembly, the contact assembly 102 is loaded into the cavity 140. For example, the contact assembly 102 may be rear loaded into the front housing 150. Once loaded, the rear housing 152 is coupled to the front housing 150 to retain the contact assembly 102 in the cavity 140.

Figure 15:
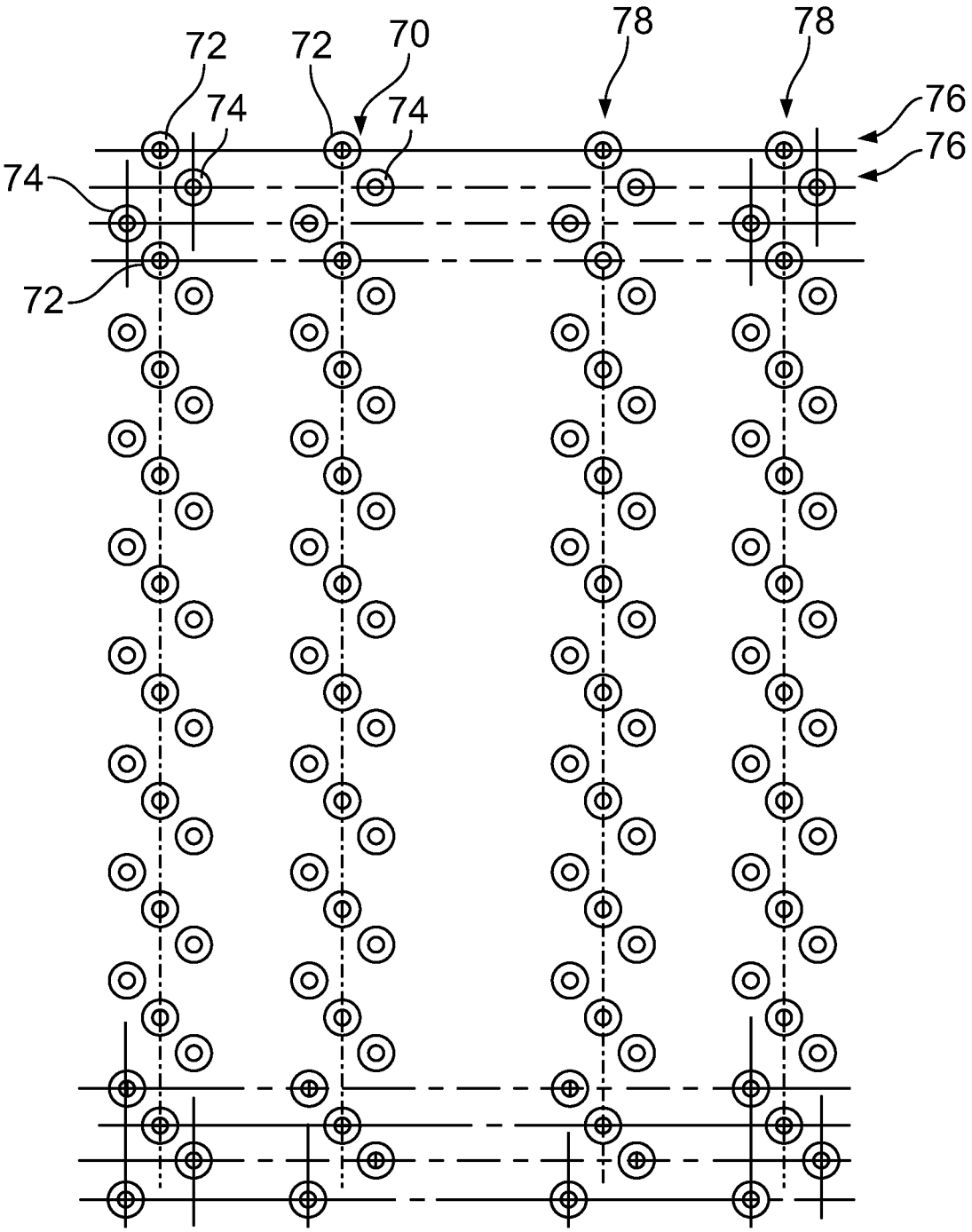
FIG. 15 is a schematic view of a pinout of plated vias of the circuit board in accordance with an exemplary embodiment.

FIG. 15 is a schematic view of an exemplary embodiment of a pinout of plated vias 70 of the circuit board 14 configured to receive the compliant pins of the contact assembly 102. The plated vias 70 include ground vias 72 and signal vias 74. The vias 70 are arranged in rows 76 and columns 78.

The rows are configured to receive compliant pins of the same contact module. For example, starting at the top, the first row includes the ground vias 72 that receive the compliant pins 368 from one of the ground contact modules 204, the second row includes the signal vias 74 that receive the compliant pins 268 from one of the signal contact modules 202, the third row includes the signal vias 74 that receive the compliant pins 268 from another of the signal contact modules 202, and the fourth row includes the ground vias 72 that receive the compliant pins 368 from another of the ground contact modules 204.

The columns are configured to receive compliant pins from all of the contact modules. For example, starting at the left, the first column includes the ground vias 72 and the signal vias 74 from the forwardmost compliant pins 368, 268 of all of the ground contact modules 204 and signal contact modules 202. Similarly, the second, third, and fourth columns include the ground vias 72 and the signal vias 74 from the compliant pins 368, 268 of all of the contact modules. In an exemplary embodiment, the signal vias 74 are offset such that the signal vias are staggered within the columns. Staggering the signal vias 74 may allow tighter spacing and/or better trace routing. Staggering the signal vias 74 may improve electrical performance through the circuit board 14.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A contact assembly comprising:

a plurality of signal contact modules and a plurality of ground contact modules arranged in a contact module stack, the ground contact modules providing electrical shielding for corresponding signal contact modules;

each signal contact module including a signal leadframe having signal conductors and a dielectric body holding the signal conductors, each signal conductor includes a transition portion extending between a mating end and a terminating end, the mating end extending from the dielectric body for electrical connection with a mating signal conductor, the terminating end of the signal conductor extending from the dielectric body for termination to a circuit board;

each ground contact module including a ground leadframe having a ground plate and a dielectric body holding the ground plate, the ground leadframe extending between a mating end and a terminating end, the mating end of the ground leadframe extending from the dielectric body, the terminating end of the ground leadframe extending from the dielectric body for termination to the circuit board, the ground plate including skewer pockets and spring fingers extending into the corresponding skewer pocket; and ground skewers extending across the contact module stack, the ground skewers being received in corresponding skewer pockets, the spring fingers engaging the ground skewers to electrically connect the ground plate to the ground skewers, wherein each ground plate is coupled to each of the ground skewers, the ground skewers electrically commoning each of the ground plates together.

2. The contact assembly of claim 1, wherein each ground skewer extends between a first end and a second end, each ground skewer having an exterior surface between the first end and the second end, each ground skewer including a plurality of contact points along the exterior surface between the first end and the second end, each contact point being electrically connected to a different ground plate.

3. The contact assembly of claim 1, wherein the ground skewers are cylindrical posts plugged through each of the signal contact module and the ground contact modules of the contact module stack.

4. The contact assembly of claim 1, wherein the spring fingers are spring biased against the ground skewers to mechanically and electrically connect the ground plates to the ground skewers.

5. The contact assembly of claim 1, wherein the spring fingers are deflectable relative to the ground plate to engage the ground skewers.

6. The contact assembly of claim 1, wherein the signal conductors within each signal contact module are separated by gaps, each gap receiving a plurality of the ground skewers.

7. The contact assembly of claim 1, wherein the dielectric body of the signal contact module includes skewer openings passing through the dielectric body, the skewer openings receiving corresponding ground skewers.

8. The contact assembly of claim 1, wherein the mating end of each signal conductor includes a spring beam, the spring beams of the signal contact modules being arranged in an upper row configured to engage mating signal conductors on an upper surface of a circuit card, the spring beams of the signal contact modules being arranged in a lower row configured to engage mating signal conductors on a lower surface of the circuit card.

9. The contact assembly of claim 1, wherein the signal contact modules are arranged in pairs including a first signal contact module and a second signal contact module, the ground contact modules flanking the first and second signal contact modules, the terminating ends of the signal conductors of the first and second signal conductors being offset relative to each other and relative to the terminating ends of the ground leadframes of the adjacent ground contact modules.

10. The contact assembly of claim 1, wherein each ground leadframe includes ground fins extending from the top of the dielectric body, the contact assembly further comprising a commoning plate having fin openings receiving corresponding ground fins, the commoning plate being coupled to each of the ground contact modules to electrically common each of the ground plates.

11. The contact assembly of claim 1, wherein the signal contact modules and the ground contact modules are arranged in a ground-signal-signal-ground arrangement in the contact module stack, the ground skewers electrically connected to both ground contact modules in the ground-signal-signal-ground arrangement, the ground skewers passing through both signal contact modules in the ground-signal-signal-ground arrangement.

12. The contact assembly of claim 1, wherein each ground skewer has a width greater than or equal to a width of the contact module stack.

13. The contact assembly of claim 1, wherein the ground skewers extend through an interior of the contact module stack, the contact assembly further comprising a commoning plate extending along an exterior of the contact module stack, the commoning plate being electrically coupled to each ground plate to electrically common each of the ground plates together.

14. An electrical connector comprising:

a housing having a cavity, the housing having a card slot at a mating end of the housing, the card slot configured to receive a card edge of a circuit card, the housing having a bottom configured to be mounted to a circuit board;

a contact assembly received in the cavity, the contact assembly including a contact module stack including a plurality of signal contact modules and a plurality of ground contact modules, the ground contact modules providing electrical shielding for corresponding signal contact modules;

each signal contact module including a signal leadframe having signal conductors and a dielectric body holding the signal conductors, each signal conductor includes a transition portion extending between a mating end and a terminating end, the mating end of the signal conductor positioned in the housing at the card slot to interface with the circuit card, the terminating end of the signal conductor extending from the housing at the bottom for termination to the circuit board;

each ground contact module including a ground leadframe having a ground plate and a dielectric body holding the ground plate, the ground leadframe extending between a mating end and a terminating end, the mating end of the leadframe positioned in the housing at the card slot to interface with the circuit card, the terminating end of the ground leadframe extending from the housing at the bottom for termination to the circuit board, the ground plate including skewer pockets and spring fingers extending into the corresponding skewer pocket; and ground skewers extending across the contact module stack, the ground skewers being received in corresponding skewer pockets, the spring fingers engaging the ground skewers to electrically connect the ground plate to the ground skewers, wherein each ground plate is coupled to each of the ground skewers, the ground skewers electrically commoning each of the ground plates together.

15. The electrical connector of claim 14, wherein the card slot is an upper card slot, the housing including a lower card slot, the mating ends of the signal contacts extending into the upper card slot and the lower card slot, the mating end of the ground leadframe extending into the upper card slot and the lower card slot.

16. The electrical connector of claim 14, wherein each ground skewer extends between a first end and a second end, each ground skewer having an exterior surface between the first end and the second end, each ground skewer including a plurality of contact points along the exterior surface between the first end and the second end, each contact point being electrically connected to a different ground plate.

17. The electrical connector of claim 14, wherein the signal conductors within each signal contact module are separated by gaps, each gap receiving a plurality of the ground skewers.

18. An electrical connector assembly comprising:

a receptacle cage including cage walls forming a module channel configured to receive a pluggable module, the cage walls configured to be mounted to a circuit board; and an electrical connector received in the receptacle cage for electrical connection to the pluggable module, the electrical connector configured to be electrically connected to the circuit board, the electrical connector comprising:

a housing having a cavity, the housing having a card slot at a mating end of the housing, the card slot configured to receive a card edge of a circuit card of the pluggable module, the housing having a bottom configured to be mounted to a circuit board;

a contact assembly received in the cavity, the contact assembly including a contact module stack including a plurality of signal contact modules and a plurality of ground contact modules, the ground contact modules providing electrical shielding for corresponding signal contact modules;

each signal contact module including a signal leadframe having signal conductors and a dielectric body holding the signal conductors, each signal conductor includes a transition portion extending between a mating end and a terminating end, the mating end of the signal conductor positioned in the housing at the card slot to interface with the circuit card, the terminating end of the signal conductor extending from the housing at the bottom for termination to the circuit board;

each ground contact module including a ground leadframe having a ground plate and a dielectric body holding the ground plate, the ground leadframe extending between a mating end and a terminating end, the mating end of the leadframe positioned in the housing at the card slot to interface with the circuit card, the terminating end of the ground leadframe extending from the housing at the bottom for termination to the circuit board, the ground plate including skewer pockets and spring fingers extending into the corresponding skewer pocket; and ground skewers extending across the contact module stack, the ground skewers being received in corresponding skewer pockets, the spring fingers engaging the ground skewers to electrically connect the ground plate to the ground skewers, wherein each ground plate is coupled to each of the ground skewers, the ground skewers electrically commoning each of the ground plates together.

19. The electrical connector assembly of claim 18, wherein the card slot is an upper card slot, the housing including a lower card slot, the mating ends of the signal contacts extending into the upper card slot and the lower card slot, the mating end of the ground leadframe extending into the upper card slot and the lower card slot.

20. The electrical connector assembly of claim 18, wherein each ground skewer extends between a first end and a second end, each ground skewer having an exterior surface between the first end and the second end, each ground skewer including a plurality of contact points along the exterior surface between the first end and the second end, each contact point being electrically connected to a different ground plate.

* * * * *